US006253035B1

(12) United States Patent
Kawana et al.

(10) Patent No.: US 6,253,035 B1
(45) **Date of Patent: *Jun. 26, 2001**

(54) IMAGE FORMING APPARATUS HAVING MEANS FOR DETECTING AMOUNT OF DEVELOPER USED AND MEANS FOR DETECTING FAILURE OF USED DEVELOPER AMOUNT DETECTING MEANS

(75) Inventors: Takashi Kawana, Yokohama; Hiroshi Sasame, Numazu; Yoshimi Ogasawara, Shizuoka-ken; Fumihiro Ueno, Mishima; Eiichiro Teshima, Odawara; Tomoyuki Okada, Shizuoka-ken, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/103,583

(22) Filed: Jun. 24, 1998

(30) Foreign Application Priority Data

Jun. 24, 1997 (JP) ..... 9-183120

(51) Int. Cl.[7] ..... G03G 15/00; G03G 21/00

(52) U.S. Cl. ..... 399/24; 399/27; 399/35

(58) Field of Search ..... 399/35, 9, 24, 399/25, 26, 27, 123; 340/612

(56) References Cited

U.S. PATENT DOCUMENTS

| | | | | |
|---|---|---|---|---|
| 4,711,561 | * | 12/1987 | Tsuruoka | 399/35 |
| 5,021,828 | * | 6/1991 | Yamaguchi et al. | 399/24 |
| 5,500,716 | * | 3/1996 | Morishita et al. | 399/35 |
| 5,572,292 | * | 11/1996 | Chatani et al. | 399/25 |
| 5,822,646 | * | 10/1998 | Kinoshita et al. | 399/24 |

FOREIGN PATENT DOCUMENTS

| | | | |
|---|---|---|---|
| 60-142360 | * | 7/1985 | (JP) . |
| 7-253738 | * | 10/1995 | (JP) . |

* cited by examiner

*Primary Examiner*—Sophia S. Chen
(74) *Attorney, Agent, or Firm*—Fitzpatrick, Cella, Harper & Scinto

(57) ABSTRACT

An image forming apparatus includes an image bearing member, a container for containing a developer removed from the image bearing member, a detector for detecting an amount of developer removed from the image bearing member and contained in the container, and a failure detector for detecting a failure of the developer amount detector on the basis of the degree of use of the image bearing member and a detection result of the developer amount detector.

18 Claims, 15 Drawing Sheets

IMAGE FORMING APPARATUS HAVING MEANS FOR DETECTING AMOUNT OF DEVELOPER USED AND MEANS FOR DETECTING FAILURE OF USED DEVELOPER AMOUNT DETECTING MEANS

FIELD OF THE INVENTION AND RELATED ART

The present invention relates to an image forming apparatus such as a copying machine or a printer.

An electrophotographic image forming apparatus such as a printer or a copying machine is a widely used monochromatic image forming apparatus or a color image forming apparatus.

In an example of the color image forming apparatus, an image is formed on an electrophotographic photosensitive member in the form of a photosensitive drum through charging, laser exposure and development processes, and is transferred onto a transfer belt. These processes are repeated through a plurality of turns so that a color image is formed on the transfer belt. Then, the image is transferred onto a transfer sheet, thus providing a color print or copy.

A photosensitive drum unit of such a color image forming apparatus is provided with a removed toner container, a capacity of which is normally 2 times or 3 times the lifetime of the photosensitive drum. Therefore, it is not probable that any removed toner will overflow to scatter in the color image forming apparatus and contaminate the inside thereof. Some of the photosensitive drum units are provided with a check window permitting the user to check the toner level.

However, when the main assembly of the apparatus is designed to be small, the capacity of the removed toner container may be limited.

In such a case, some apparatuses are provided with a function of monitoring the toner amount in the removed toner container and notifying the user of the full state of the removed toner container when the full state is near or has been or is reached.

The sensor for monitoring the amount of the removed toner may optically detect the amount of the removed toner, may measure the weight of the removed toner, or the like. However, in any case, the sensor may not operate normally due to sensor trouble such as contamination of the sensor, disconnection of the cable, lifetime of the sensor or the like.

SUMMARY OF THE INVENTION

Accordingly, it is a principal object of the present invention to provide an image forming apparatus wherein when an abnormality occurs in a sensor for detecting an amount of the removed toner, the occurrence is notified to the user.

It is another object of the present invention to provide an image forming apparatus wherein an amount of the removed toner can be correctly detected.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described.

(Embodiment 1)

Figure 1:
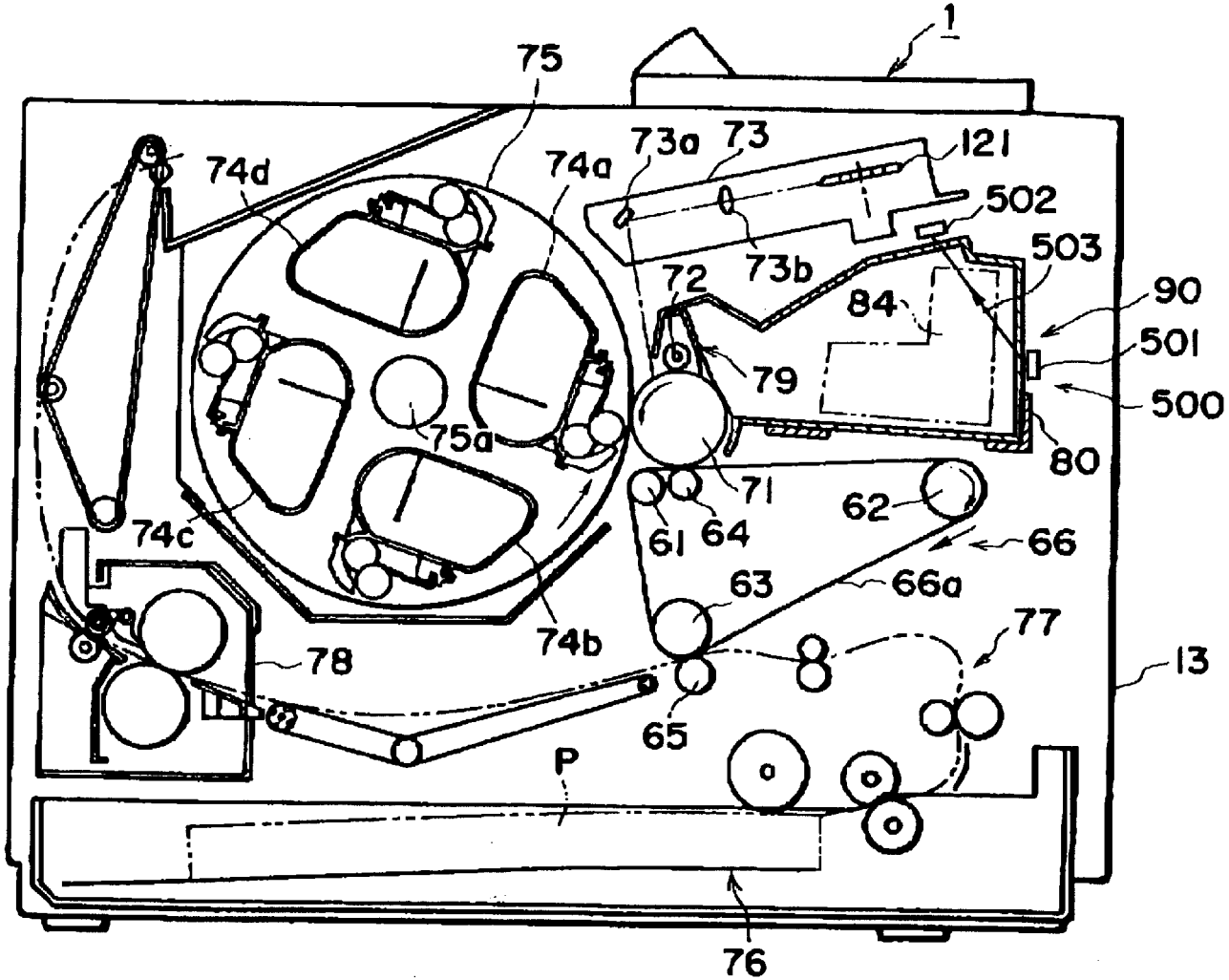
FIG. 1 shows a general arrangement of a printer which is an electrophotographic image forming apparatus according to an embodiment of the present invention.

FIG. 1 shows a color laser beam printer as an exemplary electrophotographic image forming apparatus according to Embodiment 1 of the present invention, which is operable with the resolution of 600 dots/inch (dpi) and which processes 8 bit data for a pixel for each color component.

In the color laser beam printer of this embodiment, the toner image formed on the photosensitive drum 71 is first transferred onto the intermediary transfer unit 66, from which the toner image is transferred onto the transfer sheet P all together.

In FIG. 1, the photosensitive drum 71, is driven in the direction indicated by the arrow in the Figure by an unshown driving means, and is charged uniformly to a predetermined potential by roller charging means 72. Subsequently, a laser beam is projected onto the photosensitive drum 71 by an exposure device 73 supplied with inputs corresponding to a yellow image pattern, so that an electrostatic latent image is formed on the photosensitive drum 71.

When the photosensitive drum 71 further rotates in the direction indicated by the arrow, a developing device 74*a* accommodating yellow toner among the developing devices

74*a,* 74*b,* 74*c,* 7*d* supported on a turret type supporting member 75 supported on a shift 75*a,* is faced to the photosensitive drum 71 by the rotation of the supporting member 75, and the electrostatic latent image is visualized (developed) by the developing device 74*a* into a developed image.

Then, the developed toner image is transferred onto the intermediary transfer belt 66*a* which is an intermediary transfer member. After the image transfer, the toner remaining on the photosensitive drum 71 is removed by the cleaning device 79 and is received by the removed toner container 84.

The amount of the removed toner retained in the removed toner container 84 is detected by a FULL sensor 500 which is an optical detecting means provided in the apparatus. The FULL sensor 500 comprises an emitting portion 501 and a photo-receptor portion 502, and the light 503 emitted from the emitting portion 501 is directed to the photo-receptor portion 502 through the removed toner container 84. By detecting the light quantity received thereby, the amount of toner is detected.

The intermediary transfer belt 66*a* moves in the direction indicated by the arrow in the Figure by rotation of the three supporting rollers 61, 62, 63. Inside the intermediary transfer belt 66*a,* a primary transfer roller 64 is provided faced to the photosensitive drum 71, and a predetermined bias is applied from an unshown high voltage source to the primary transfer roller 64 to transfer the toner from the photosensitive drum 71 onto the intermediary transfer belt 66*a.*

The foregoing processes are repeated for the magenta, cyan and black color using the developing devices 74*b,* 74*c,* 74*d,* so that four color toner images are superimposedly formed on the intermediary transfer belt 66*a.*

The four color toner images are transferred all together by a secondary transfer roller 65 onto the transfer sheet P fed by feeding means 77 from a sheet feeding device 76 in synchronism with the movement of the intermediary transfer belt 66*a.* The transfer sheet P is subjected to a fixing operation by a press-fixing device 78 so that the image is fused and fixed into a color image.

The charging roller 72, the photosensitive drum 71, the cleaning device 79 and the removed toner container 84 are constituted into a process cartridge 90, which is detachably mountable as a unit relative to the main assembly 13 of the apparatus along apparatus guide means 80. The developing devices 74*a*–74*d* are also detachably mountable relative to the supporting member 75 mounted to the main assembly 13 of the apparatus, similarly to the process cartridge 90. With these structures, the exchange and maintenance of parts which have been carried out by serviceman, can now be carried out by the user.

The process means actable on the photosensitive drum 71 includes the charging roller 72, the cleaning device 79 and the removed toner container 84 in this embodiment.

Figure 3:
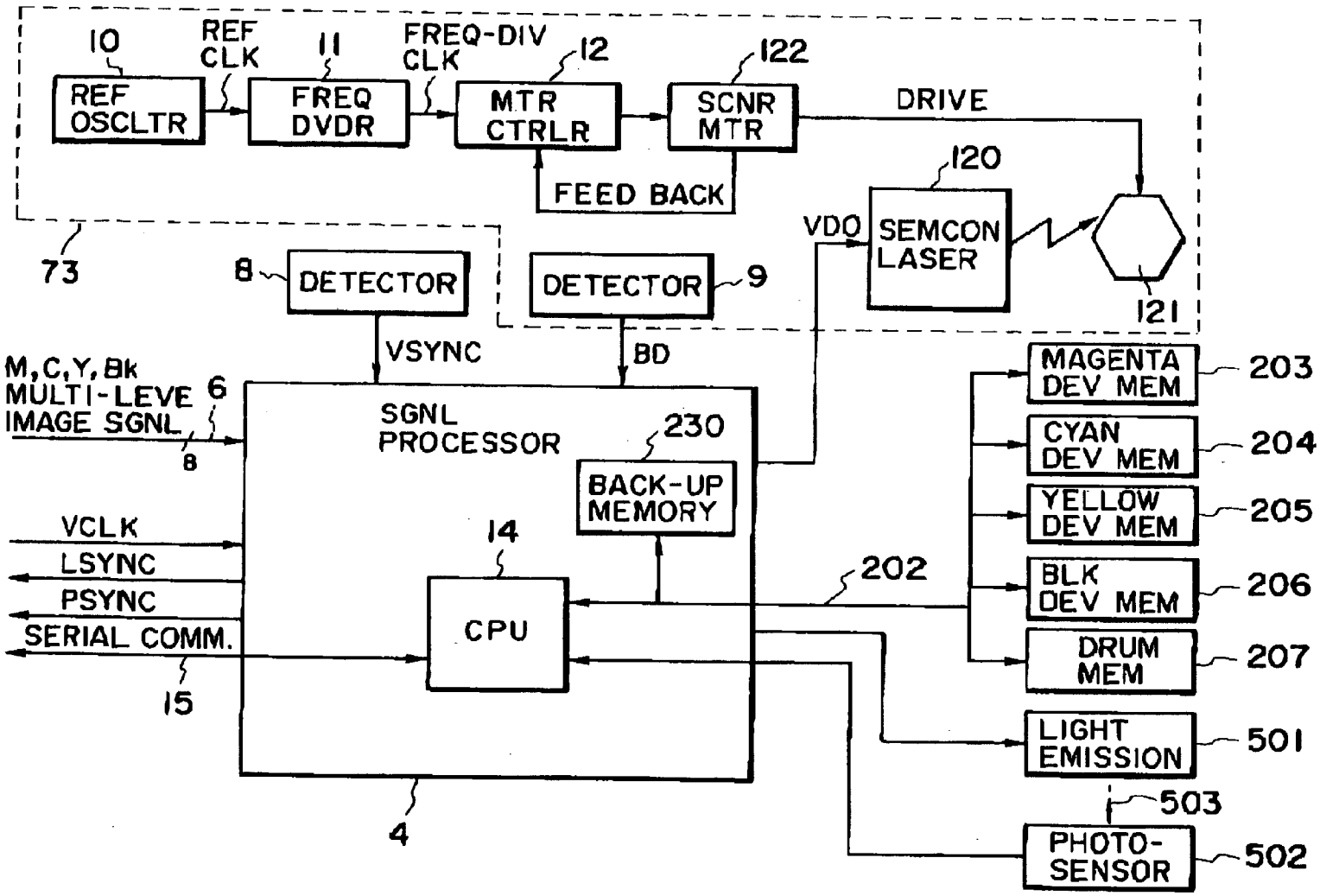
FIG. 3 is a block diagram of operation of a printer engine.

The exposure device 73, as will be understood from FIG. 3, comprises a semiconductor laser 120, a laser driving circuit, a polygonal mirror 121, a scanner motor 122, an imaging lens 73*b,* folding mirrors 73*a* and BD, and a detection circuit.

When print start instructions are generated by the printer controller 2 (FIG. 2), the scanner motor 122 is driven. When normal rotation is reached, the printer controller 2 transmits a yellow color image signal. In response to the image signal, the semiconductor laser 120 emits light toward the polygonal mirror 121 which is now under normal rotation, so that a laser beam is projected on the photosensitive drum 71 through the polygonal mirror 121, the imaging lens 73*b* and the folding mirror 73*a.*

When the laser beam is emitted, the laser beam is detected by a detection device 9 disposed on the main-scan axis, and a horizontal synchronization signal BD signal is outputted. As a result, a scanning exposure of the photosensitive drum 71 is effected in synchronism with the BD signal by the laser beam, so that an electrostatic latent image is formed.

As described in the foregoing, the electrostatic latent image is developed by the developing device 74*a* accommodating the yellow toner.

The processes are repeated for four colors, and the four color images are transferred superimposedly onto the intermediary transfer belt, 66*a* of the intermediary transfer unit 66. On the other hand, the transfer sheet P is fed in synchronism with the superimposing transfer, and the image formed on the transfer belt 66*a* is transferred (secondary transfer) onto the transfer sheet P.

The color laser beam printer of the embodiment produces images through such processes at a resolution of 600 dot/inch (dpi).

The input data for the printer are for example color image data (for example, data of RGB components) generated by a host computer or image data stored in a storing medium generated by another image data generating apparatus (still image recorder or the like). The printer of the embodiment, as shown in FIG. 2, includes a printer controller 2 for receiving the image information from the host computer 1000 and generating the image data, and a signal process portion 4 (FIG. 3) for processing the image data.

In the following embodiments, the color image data fed from the host computer 1000 are taken as the input data.

Figure 2:
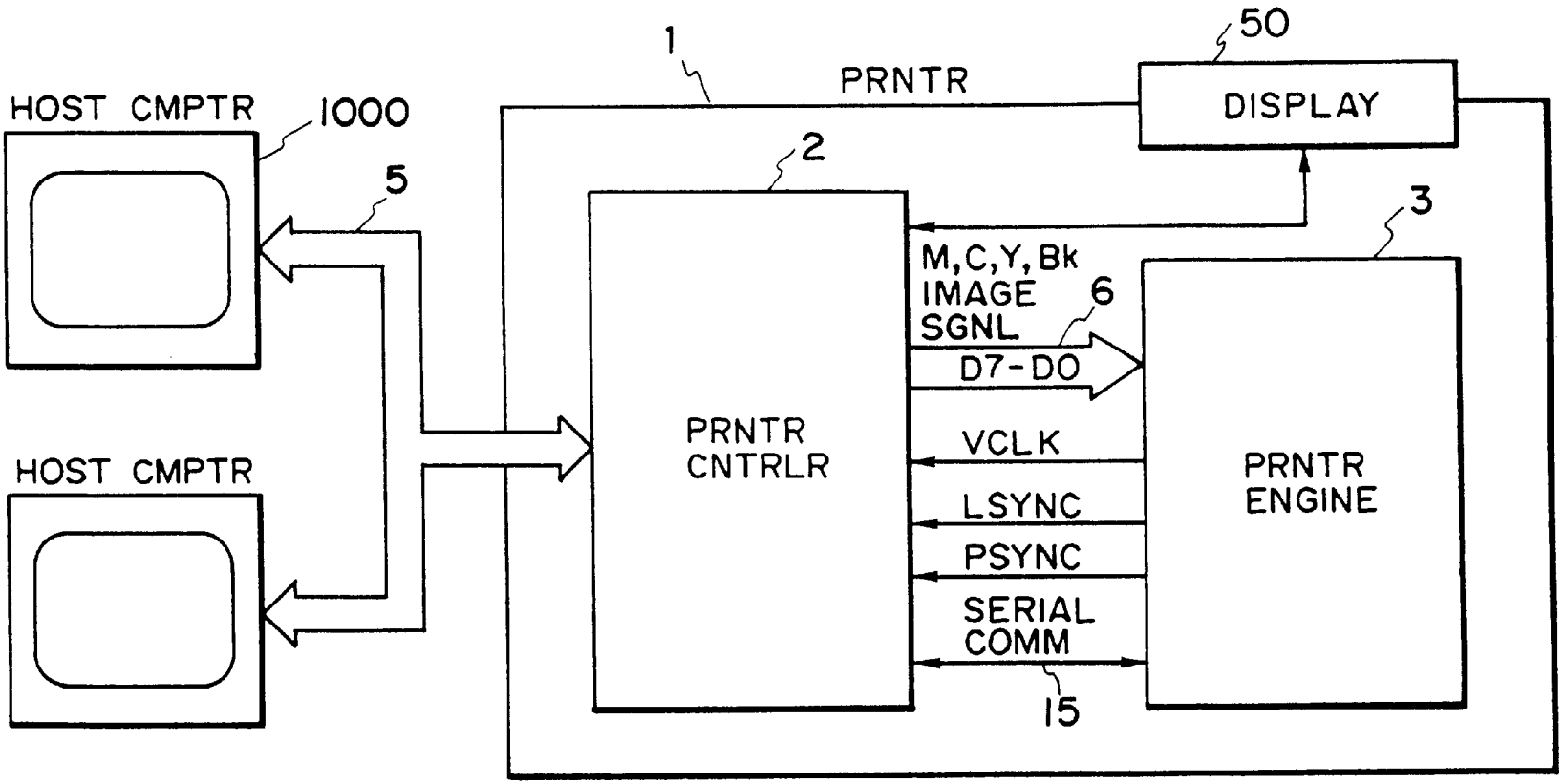
FIG. 2 is a block diagram of operation of the image forming apparatus of FIG. 1.

FIG. 2 is a block diagram showing the function of the printer 1 of this embodiment In FIG. 2, the printer 1 includes the printer engine 3 and the printer controller 2 for receiving the image information 5 of a predetermined language from the host computer 1000 and converting the information to Y, M, C, Bk image signals 6 constituted by 8 bits (D0–D7) for each color component. Or, the host computer 1000 supplies the bit data of RGB read by an image reader or the like as the image information 5, and in this case, the printer controller 2 does not make any conversion.

Between the printer controller 2 and the printer engine 3, various image signals as well as the image signals 6 are transferred through serial communication. Such image signals include a page (sub-scan direction) synchronization signal (PSYNC) supplied to the printer controller 2 from the printer engine 3, a main-scanning direction synchronization signal (LSYNC), and a clock (VCLK) for data transfer. The printer controller 2 outputs the image signal 6 as the 8 bit signal for each color component in synchronism with the clock (VCLK) for the data transfer.

The display 50 may be in the form of a liquid crystal display or the like which functions to notify to the user of the state of the printer controller 2 or the printer engine 3. Examples of what is notified include to warning of the absence of paper, the remaining toner amount and the printing state. The display may be provided with switches to permit various settings for the printer. They include setting of the printer controller 2 such as print density FIG. 3 is a block diagram showing the function of the printer engine 3, according to this embodiment. In FIG. 3, the reference clock from the reference oscillator 10 included in the exposure device 73, is subjected to a frequency dividing operation by a frequency dividing device 11, and the scanner motor 122 is rotated at the constant speed by the motor control circuit 12 such that a phase difference between the frequency-divided clock and the feed-back signal from the scanner motor 122, is a redetermined difference. The motor control circuit 12 has a known built-in phase control circuit (not shown). The rotation of the scanner motor 122 is transmitted to the polygonal mirror 121, and the polygonal mirror 121 is rotated at a constant speed.

On the other hand, the intermediary transfer belt 66*a* is rotated by a driving motor (unshown), and when a predetermined position thereof is reached, the detection device 8 generates a perpendicular synchronization signal (VSYNC). After the perpendicular synchronization signal (VSYNC) is outputted, the image signal (VDO) is supplied to the semiconductor laser 120 sequentially with the BD signal generated by the detection device 9 used as a horizontal synchronization signal (HSYNC).

The CPU 14 built in the signal process portion 4 performs serial communication with the printer controller 2 through the communication line 15 to exchange the control signals to synchronize the printer controller 2 and the printer engine 3. By the CPU 14, communication is carried out among the developing device memory 203–206, the photosensitive drum memory 207 and the back-up memory 230 through the serial communication line 202.

Developing device memory 203–206 is in the form of an EEPROM mounted to each of the developing devices 74*a*, 74*b*, 74*c*, 74*d*, and the photosensitive drum memory 207 is in the form of an EEPROM mounted to the process cartridge 90, namely, the photosensitive drum cartridge 90. The signal process portion 4 is connected with the emitting portion 501 of the collected toner FULL-sensor, and the CPU 14 is connected with the photo-receptor portion 502.

Figure 4:
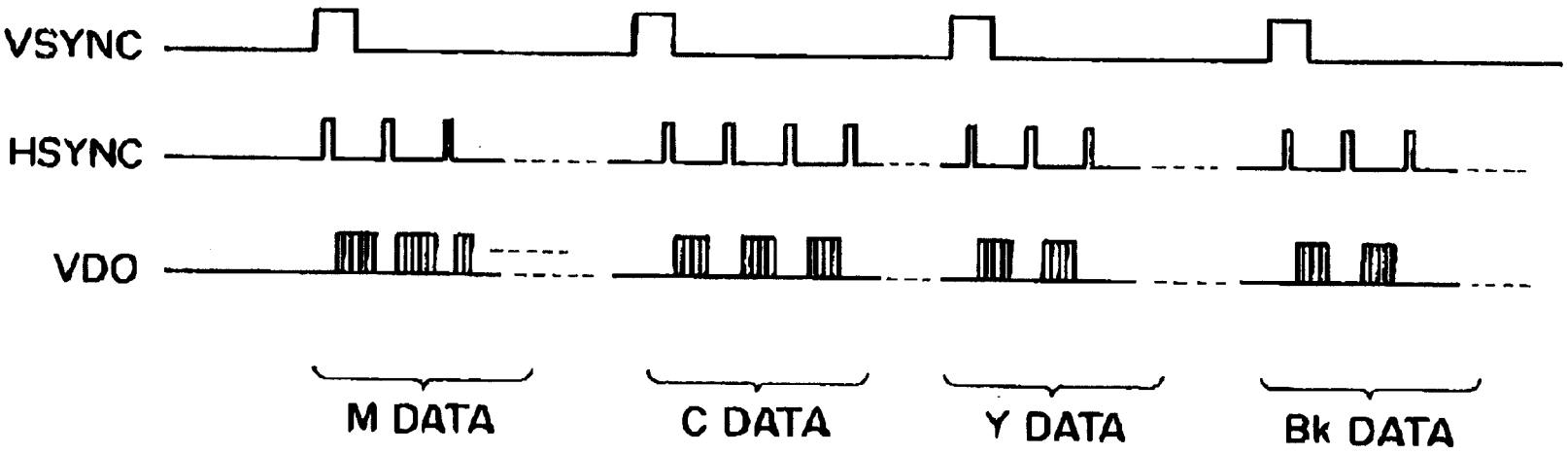
FIG. 4 is a waveform graph showing timing of a perpendicular synchronization signal (VSYNC), a horizontal synchronization signal (HSYNC) and an image signal (VDO).

As to the timing of the perpendicular synchronization signal (VSYNC), horizontal synchronization signal (HSYNC) and the image signal (VDO) in the image forming process, as shown in FIG. 4, M (magenta) data, C (cyan) data, Y (yellow) data and Bk (black) data are produced in this order, and the three signals are slightly deviated.

Figure 5:
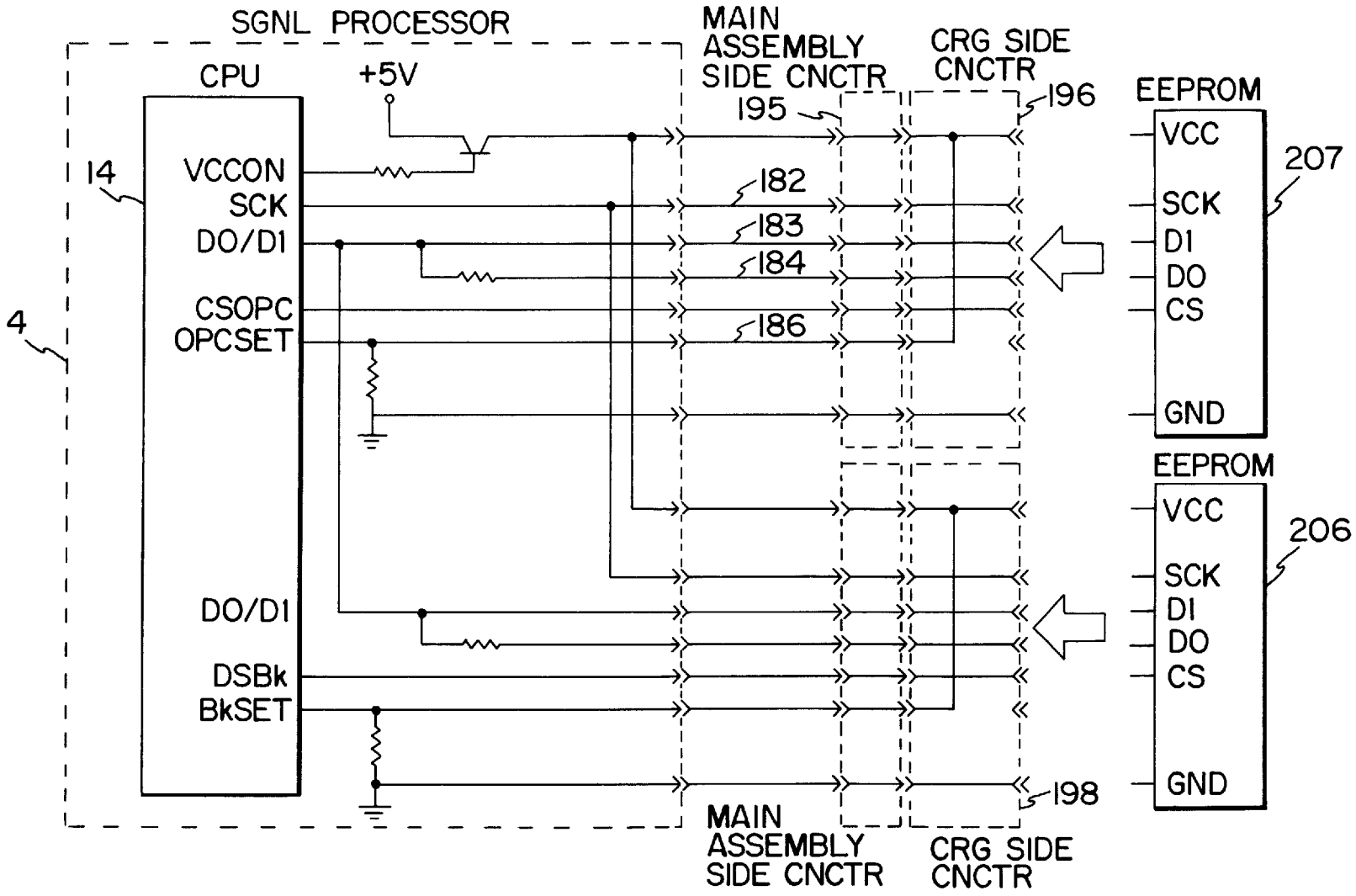
FIG. 5 is an illustration of connections among a signal process portion, a black developing device memory and a photosensitive drum memory.

FIG. 5 shows the signal communication between the signal process portion 4 and the black developing device memory 206 CPU 14 controls various signals such as VCCON, SCK, D0/D1, CSOPC, OPCSET, DSBk, and BkSET.

In the same Figure, the connector (first connector) 196 at the process cartridge (CRG) 90 side has one side as a connector engagement surface and the other side formed into an IC socket, and is mounted to the process cartridge 90 while the photosensitive drum memory 207, namely, the EEPROM 207 is inserted in the socket. It is engaged with the connector (second connector) 195 at the main assembly side of the image forming apparatus to supply the signal to the CPU 14 of the signal process portion 4.

A VCC supplied to the EEPROM 207 can be rendered on and off by the CPU 14, and when the level of the VCCON at the CPU port is low, the main switch is on, and when it is high, the main switch is off. The CPU 14 causes a supply of electric power in the reading operation or writing operation of the EEPROM 207, and in the leading operation, it supplies the data signal 183 to the EEPROM 207 in synchronism with the clock signal 182 to write the same in the memory. Signal 186 is indicative of the absence or presence of the photosensitive drum, and is monitored by the CPU 14. "Low" indicates the absence of the process cartridge 90, and "high" indicates the presence of the process cartridge 90. The detection signal becomes "high" when the process cartridge 90 is inserted into the main assembly 13 of the apparatus so that connectors are engaged, and the VCC of the EEPROM 207 is returned.

The cartridge side connector 198 is mounted to the black color developing cartridge while the black developing device memory 206, that is, EEPROM 206 is inserted. As regards the signal communication, the same as with the above-described process cartridge 90 applies.

Figure 6:
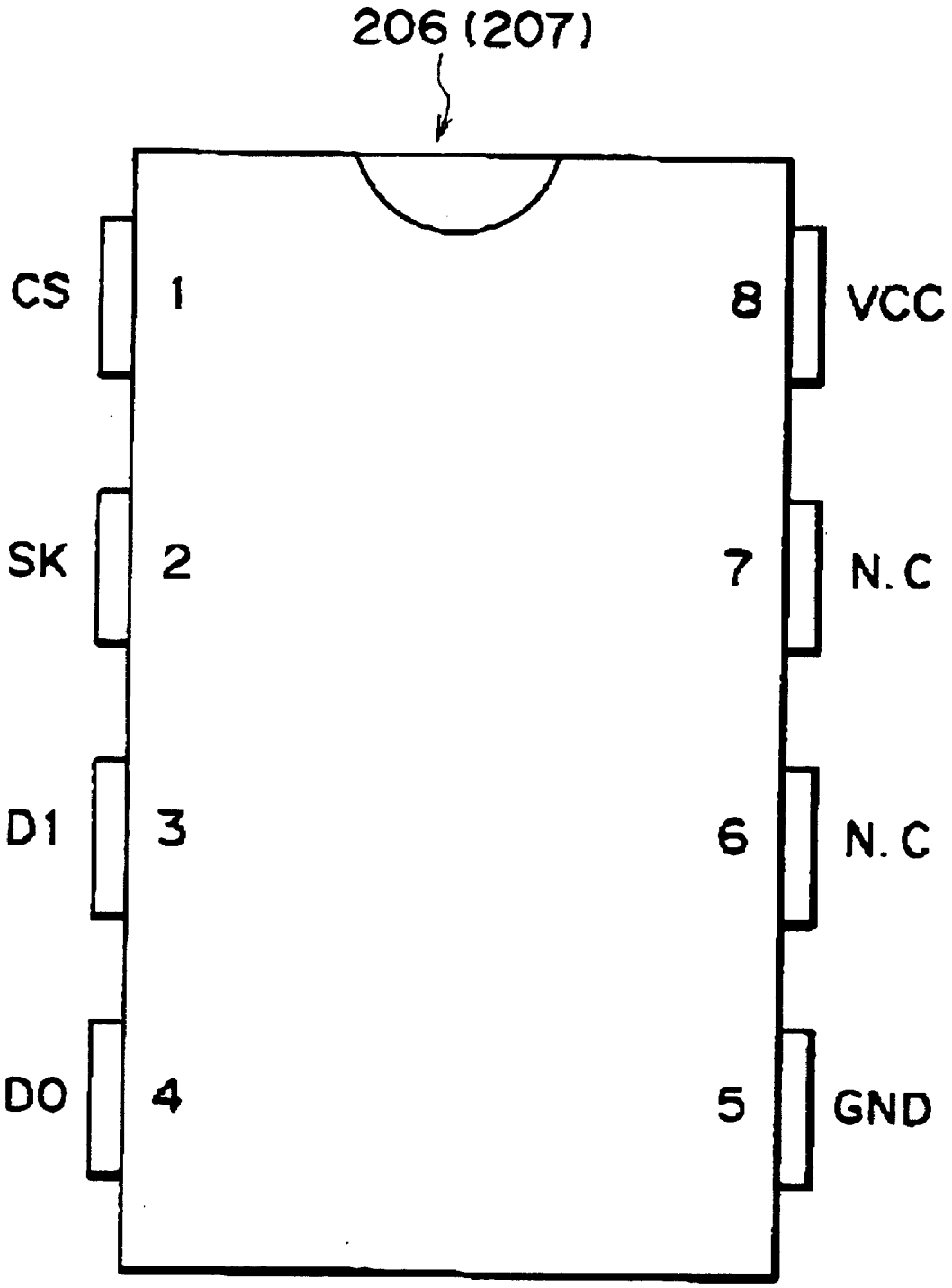
FIG. 6 is a top plan view showing a pin disposition of EEPROM-IC.

Each of the EEPROMs 207, 206 are dip-shaped ICs and are directly connected to the cartridge side connectors 196, 198. FIG. 6 shows an example of a pin arrangement of a EEPROM-IC of the dip-type for processing signals CS, SK, D1, D0, VCC, NC, and GND.

Figure 7:
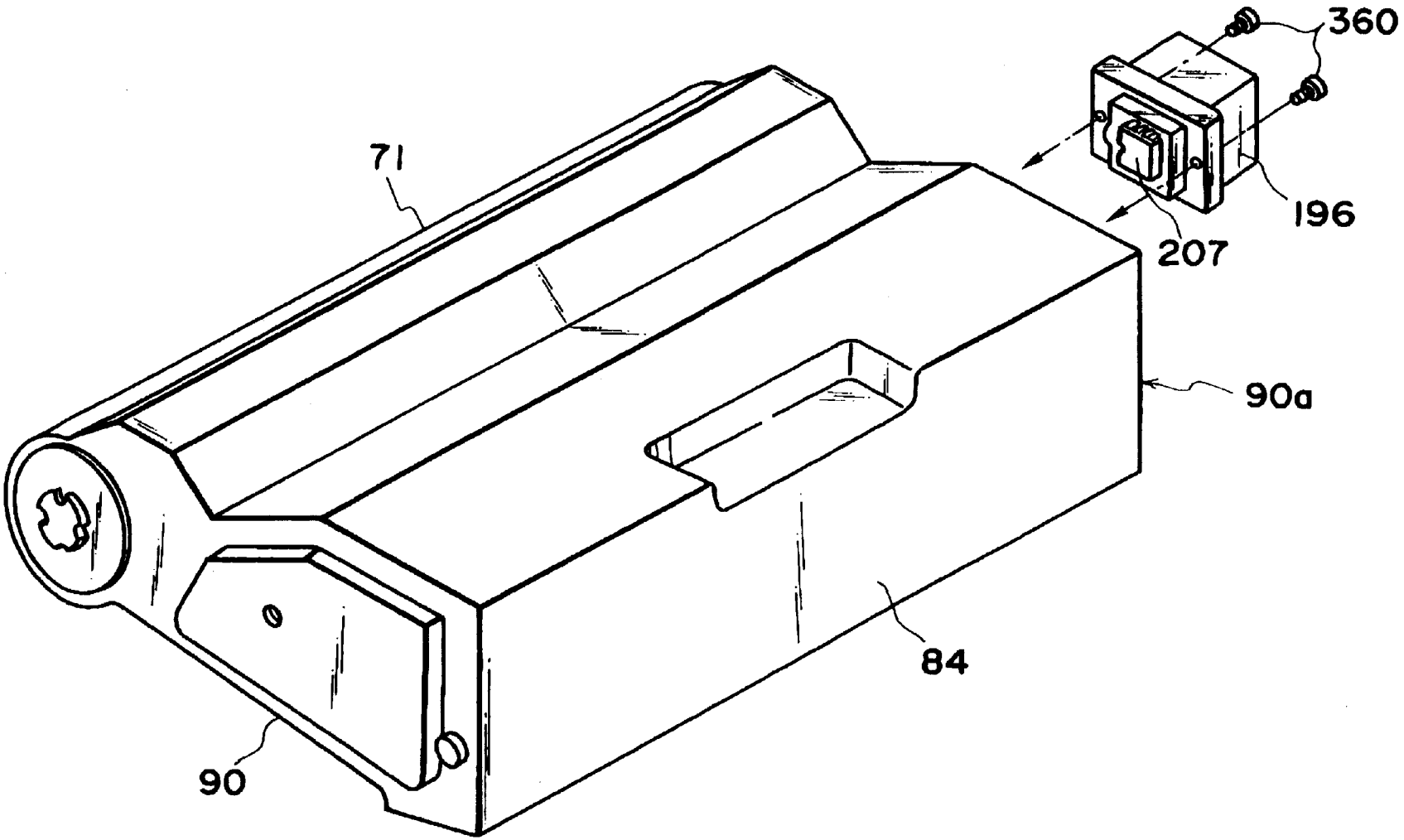
FIG. 7 is a perspective view showing mounting of a process cartridge, an EEPROM and a cartridge side connector.

FIG. 7 shows the mounting among the process cartridge 90, the EEPROM 207 and the cartridge side connector 196. The process cartridge 90 comprises the photosensitive drum 71, the removed toner container 84, the EEPROM 207, the cartridge side connector 196, and small screws 360 for mounting the connector 196 to the process cartridge 90. The cartridge side connector 196 is mounted to one end wall 90*a* of the process cartridge 90 by the small screws 360.

Figure 8:
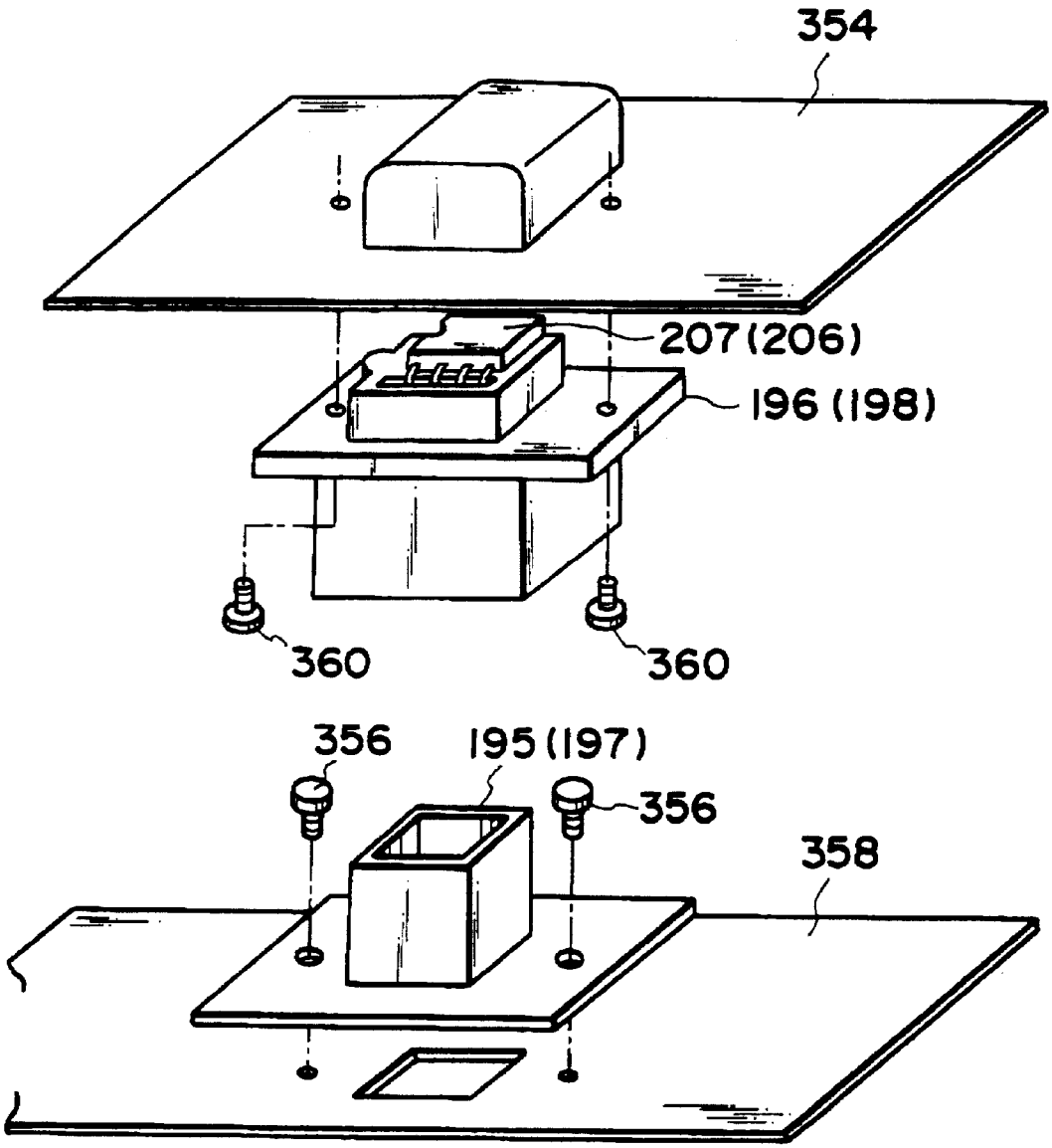
FIG. 8 is a perspective view showing a cartridge side connector, a main assembly side connector and an EEPROM.

FIG. 8 shows configurations of the cartridge side connector 196 (or 198), the main assembly side connector 195 (or 197) and the EEPROM 207 (or 206). As shown in the Figure, the cartridge side connector 196 is mounted to the connector mounting portion 354 of the process cartridge 90 using small screws 360. The main assembly side connector 195 is fixed to the connector mounting portion 358 of the main assembly 13 of the apparatus using the small screws 356.

Figure 9:
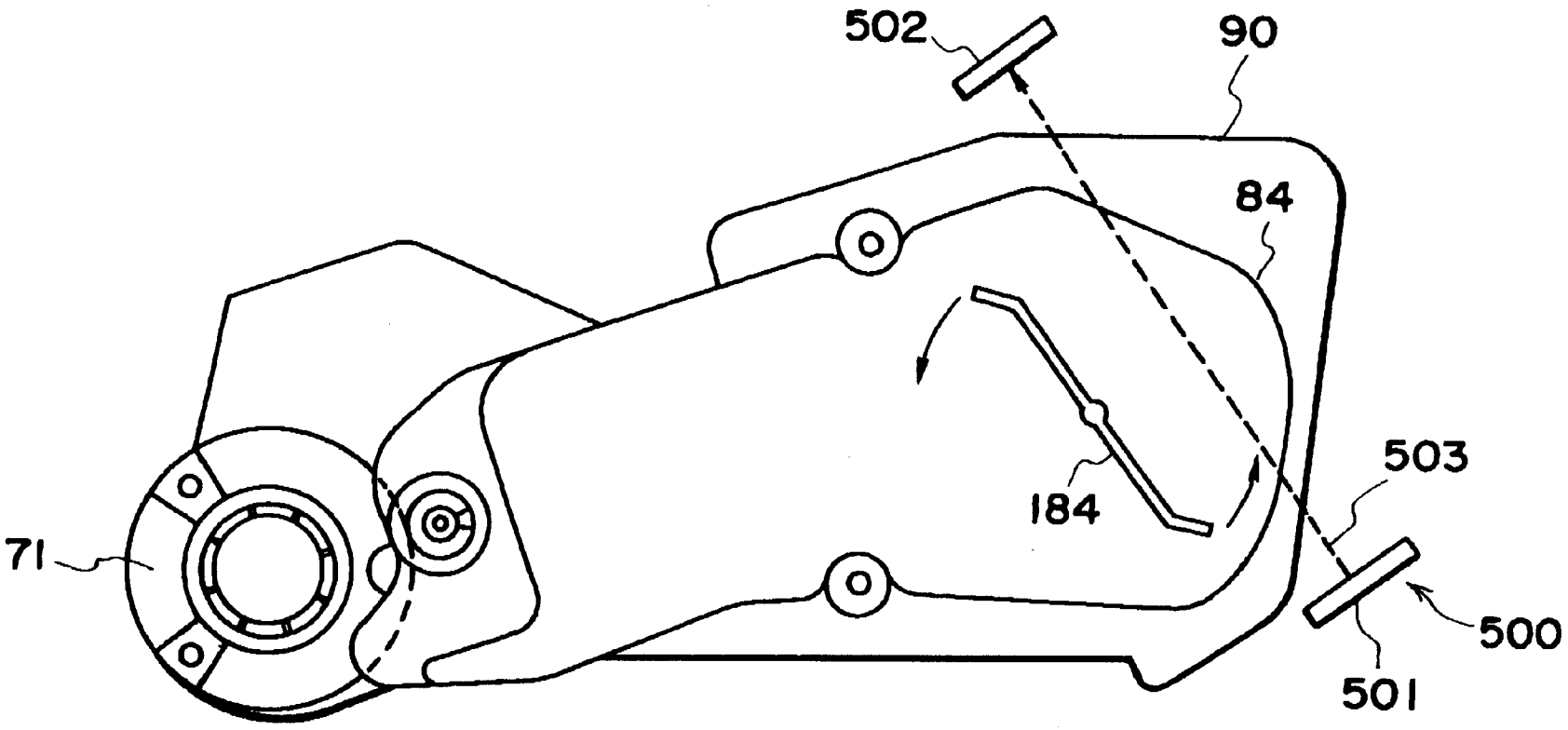
FIG. 9 is a sectional view showing a photosensitive drum cartridge and an optical path of FULL-sensor for the collected toner.

FIG. 9 shows a section of the photosensitive drum cartridge and the optical path for the collected toner FULL-sensor. In FIG. 9, the photosensitive drum cartridge 90 includes the photosensitive drum 71 and the removed toner container 84, and the removed toner container 84 is provided with a stirring plate 184 for stirring the removed toner. The collected toner FULL-sensor 500 is constituted by the emitting portion 501 and the light receiving portion 502, and the light transmitted from the emitting portion 501 is incident on the light receiving portion 502 through the optical path 503. To prevent the optical path 503 from being blocked, the molding across the optical path has a transparent port. The stirring plate 184 also functions as cleaning means for the transparent port. The sensor 500 does not detect that container 84 is so full that it cannot accept any more toner, but detects that its content is at predetermined level close to such a state.

Figure 10:
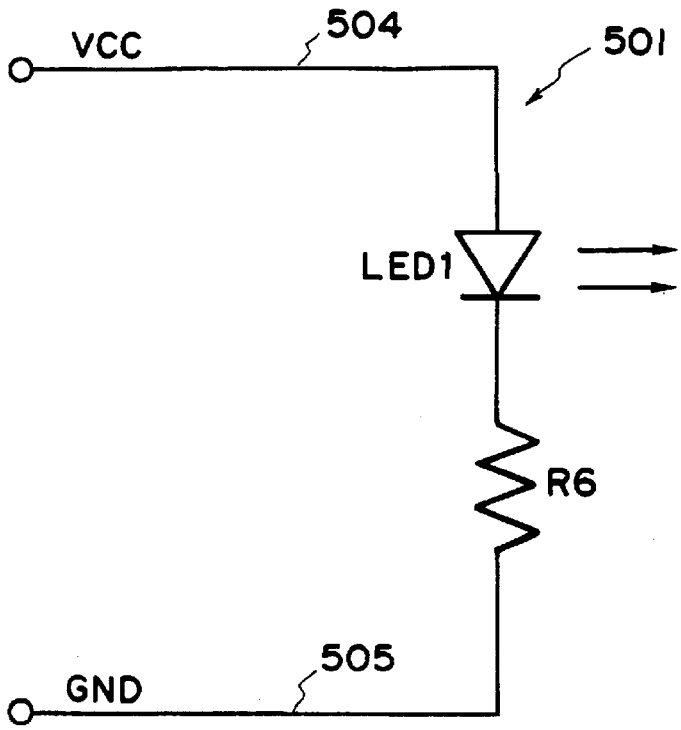
FIG. 10 shows a circuit diagram of an example of a circuit of an emitting portion of collected toner FULL-sensor.
Figure 11:
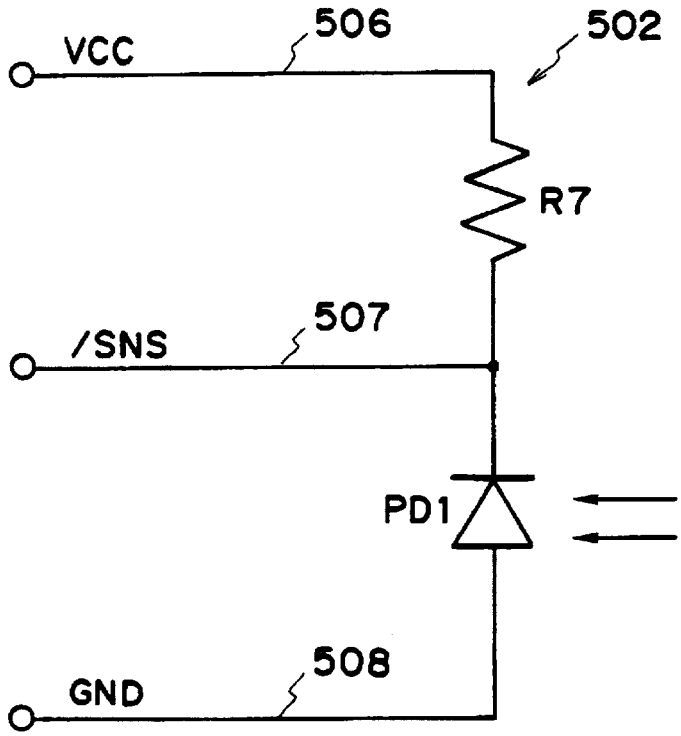
FIG. 11 is a circuit diagram of an example of a circuit of a light receiving portion of the collected toner FULL-sensor.

FIG. 10 shows an example of the circuit of the light emitting portion 501 and is constituted by light emitting diode LED1 and the resistance R6 connected across VCC on line 504 and GND on line 505. FIG. 11 is an example of the light transmitting portion 502 and is constituted by a photo-diode PD1 connected across lines 507 and 508 and a resistance R7 connected across lines 506 and 507. When the photo-diode PD1 receives light, the current flows through he resistance R7 so that level of the signal/SNS becomes "low", when it does not receive light, the current does not flow through the resistance R7 so that level of the signal/SNS is "high". The signal/SNS is supplied to a port of the unshown CPU.

Figure 12:
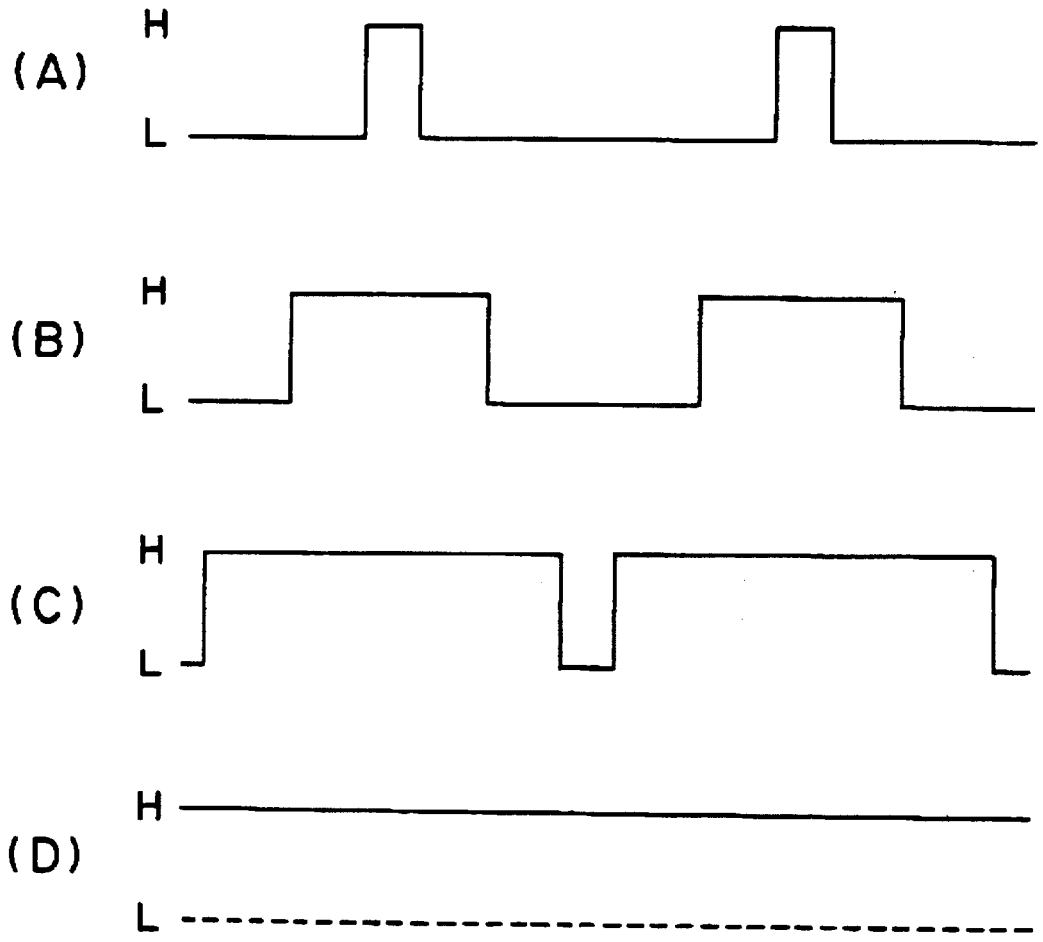
FIG. 12 is a waveform graph of a signal outputted from a light receiving portion of the collected toner FULL-sensor, wherein (A) is for a new apparatus, (B) is for the case in which some removed toner is contained, and (C) is for the case of full-state.

FIG. 12 shows a waveform of the signal/SNS outputted from the light receiving portion 502 of the collected toner FULL-sensor 500, and a waveform (A) represents the NEW state. Since there is no toner therein, the waveform exhibits a "high" level only when the stirring plate 504 blocks the optical path. As the amount of the removed toner increases, the duration in which the optical path is blocked becomes longer, as shown by waveform (B) and (C). When the removed toner container becomes full, the waveform is as shown in (D), wherein it is always "high". Even if the level becomes always "high", the removed toner container still has a small capacity remaining, and a predetermined number of printings can be produced after the detection of the full state.

Figure 13:
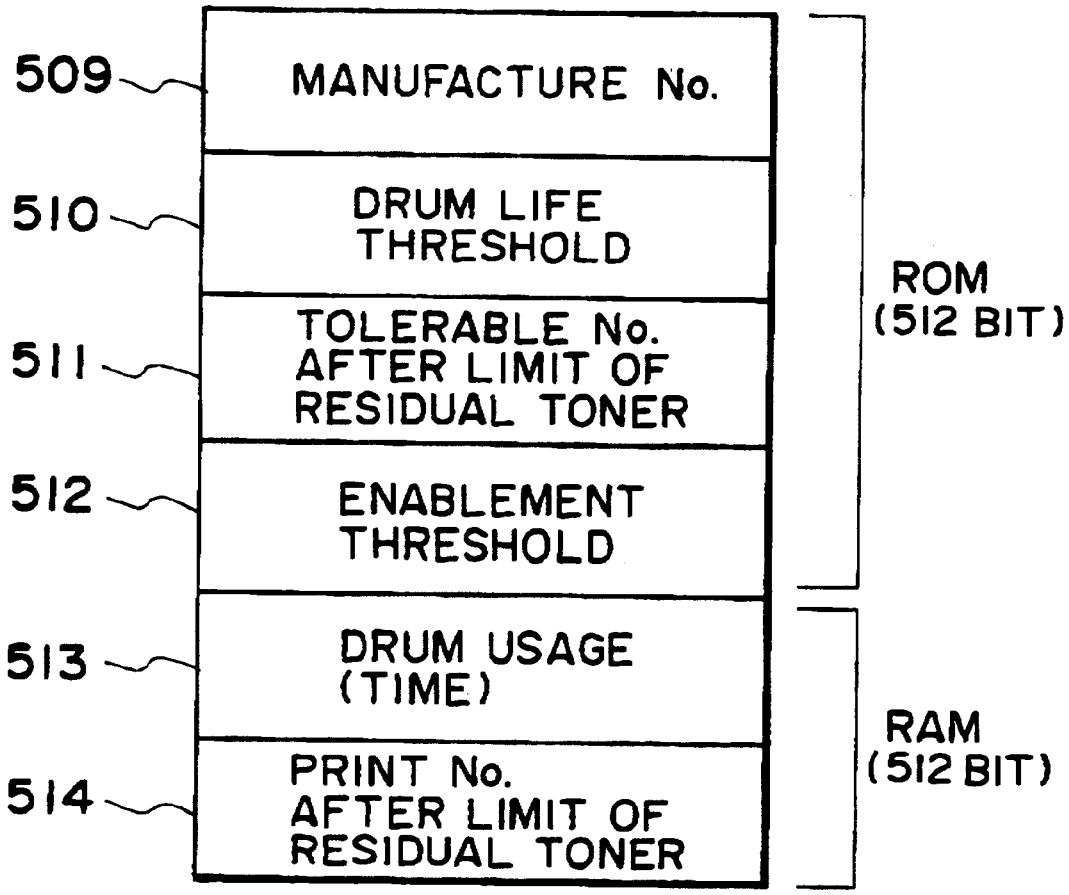
FIG. 13 is an address map showing the contents of the EEPROM provided in the process cartridge in Embodiment 1.

FIG. 13 is an address map showing the contents of the EEPROM 207 in the photosensitive drum cartridge 90. In FIG. 13, designated by 509 is a manufacturing number including a lot number and/or serial number of the cartridge; 510 is a drum lifetime threshold (cartridge lifetime is stored); 511 is printable number after the collected toner FULL detection; 512 is an enabling threshold (drum use time is stored to discriminate whether to make valid or invalid the full signal from the collected toner sensor. The data 509–512 are written in the plant in a read only memory, which the Printer can only read.

The data 513 represents the drum use time namely integrated operation time and represents the integrated use time period of the drum cartridge which is renewed with use. The data 514 is the print number after the collected toner FULL detection, and the number of prints after the detection of the collected toner FULL is renewed with use. The data 513 and 514 are zero, respectively, when delivered from the plant, and the printer overwrites the data (random access memory).

The drum use time is equal to the integrated period of time in which the high voltage for the primary charging is applied to the photosensitive drum.

Figure 14:
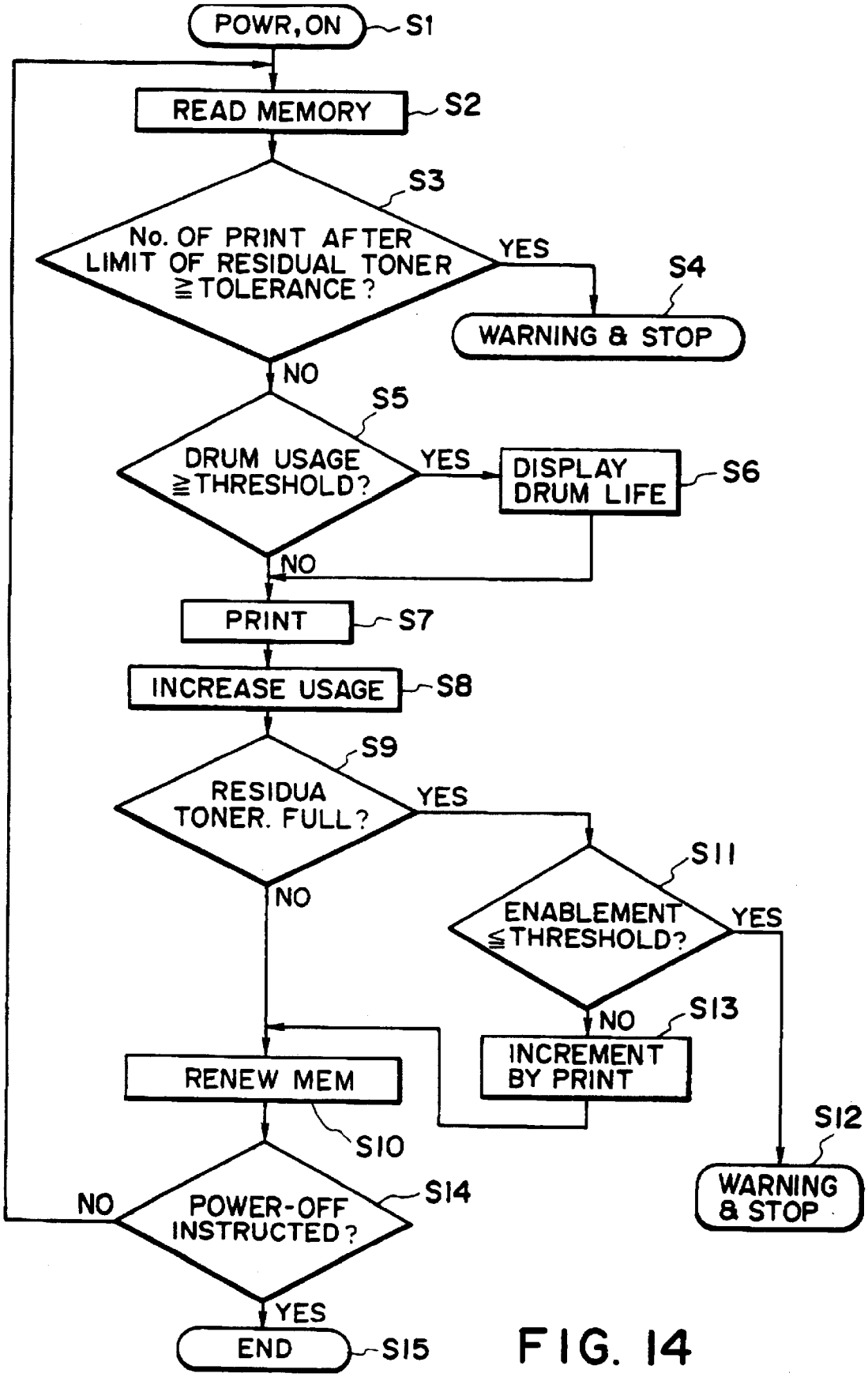
FIG. 14 is a flowchart showing an operation of the CPU in Embodiment 1.

FIG. 14 is a flowchart showing flow of operations of CPU 14 (FIG. 3). The operation will be described referring to the same Figure.

When the main switch of the main assembly of the printer is actuated (step 1 (S1)), the CPU 14 reads the data out of the EEPROM 207 in the photosensitive drum cartridge 90 ((S2)). The content read out is stored in the RAM of the CPU 14. The content read out is as shown in FIG. 13.

Among the read data, a comparison is made as to whether the print number 514 after the collected toner FU11 is larger than the tolerable number 511 (S3). If so, the collected toner full warning is displayed, and the printer operation is stored (S4). If not, the next routine is executed.

Among the read data, a comparison is made as to whether the drum use time 513 is longer than the drum threshold 510 (S5). If so, the drum life is displayed (S6), and the apparatus waits for the printing instructions. If not, the apparatus waits for the printing instructions. When the printing instructions are fed, the printing operation is carried out.

Then, the drum use time stored in the RAM of the CPU 14 is added or incremented (S8). Subsequently, the output signal of the collected toner FULL-sensor is monitored (S9). When the sensor output is not indicative of a full state, the data stored temporarily in the RAM of the CPU 14 is written in the EEPROM 207 (S10).

If the sensor output is indicative of a full state, a comparison is made as to whether the drum use time 513 is shorter than the enabling threshold 512 (S11). If so, a collected toner sensor abnormality is displayed, and the printing operation is stored (S12). In other words, when the collected toner sensor determines that a full state exits despite the fact that photosensitive drum cartridge 90 is relatively new, the diagnosis is that collected toner sensor is experiencing some abnormality or trouble. The collected toner enabling threshold 512 is preferably 20% of the drum lifetime threshold 510, for example.

If not, the print number after the collected toner FU11 stored temporarily in the RAM of the CPU 14, is incremented (S13). The data stored temporarily in the RAM of the CPU 14, is written in the EEPROM 207 (S10).

Then, the discrimination is made as to whether the deactivation of the main switch is instructed or not. If so, the main switch is deactivated (S14). If not, the above described operations are repeated. If so, the flow of operation ends (S15).

As causes of collected toner sensor abnormality, there are contamination of the LED in the light emitting portion, decrease of the light quantity due to the deterioration of the LED, the cable disconnection of the light emitting portion, contamination of the photodiode in the light receiving portion, cable disconnection of the light receiving portion, and blocking of the optical path due to incomplete insertion of the photosensitive drum cartridge. In the case of a collected toner sensor abnormality, the abnormality is repaired by a serviceman.

In this embodiment, the drum lifetime threshold 510, the tolerable number 511 after the collected toner FU11 and the collected toner enabling threshold 512 are stored in the memory 207 of the photosensitive drum cartridge, but they may be stored in the ROM of the CPU 14 in the main assembly of the printer.

In this embodiment, the drum lifetime threshold 510, the enabling threshold 512 and the drum use time 513 are based on the time period during which the high voltage for the primary charging is applied to the photosensitive drum, but the rotation time period of the photosensitive drum or the integrated number of rotations of the photosensitive drum or the print number may be used in place thereof. On the other hand, the tolerable number 511 after the collected toner FU11 and the print number 514 after the collected toner FU11, are based on the print number, but the rotation time period of the photosensitive drum, the integrated number of rotations of the photosensitive drum or the duration in which the high voltage for the primary charging is applied, may be used in place thereof.

In a case of the color printer, the print number may be determined on the basis of different weighting for monochromatic printing and for full-color printing.

In this embodiment, the photosensitive drum and the removed toner container are in a unified cartridge, but the present invention is applicable to a cartridge having an integrated photosensitive drum, removed toner container and a developing device.

The memory in the embodiment is EEPROM, but a nonvolatile memory such as a flash memory is usable.

As described in the foregoing, in this embodiment, even after the collected toner sensor detects the full state, a predetermined number of prints can be produced to the convenience of the user.

By proper setting of the enabling value, the diagnosis of the abnormality of the collected toner sensor in the main assembly of the printer is possible also in the case that the collected toner sensor is not in order at the beginning of the use of the printer or when a sensor abnormality gradually increases or the like, so that highly reliable detection of the cartridge life end is accomplished.

(Embodiment 2)

Figure 15:
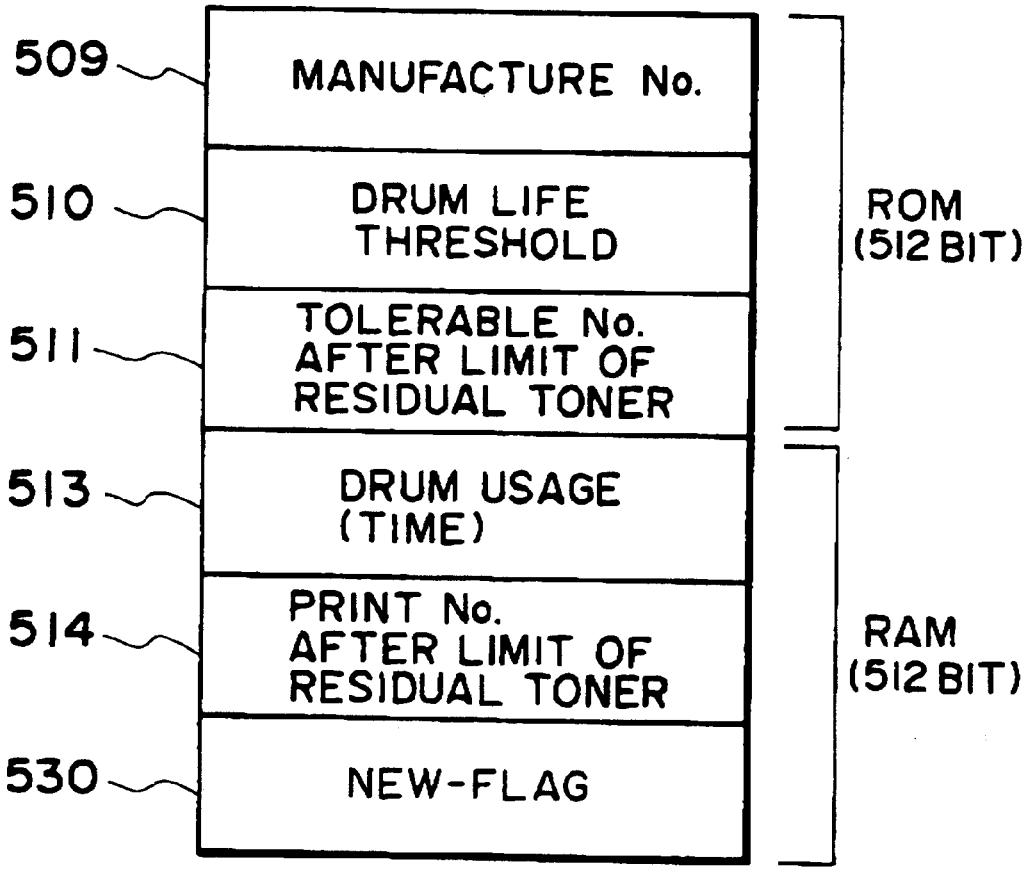
FIG. 15 is an address map showing the contents of the EEPROM provided In the process cartridge in Embodiment 2.
Figure 16:
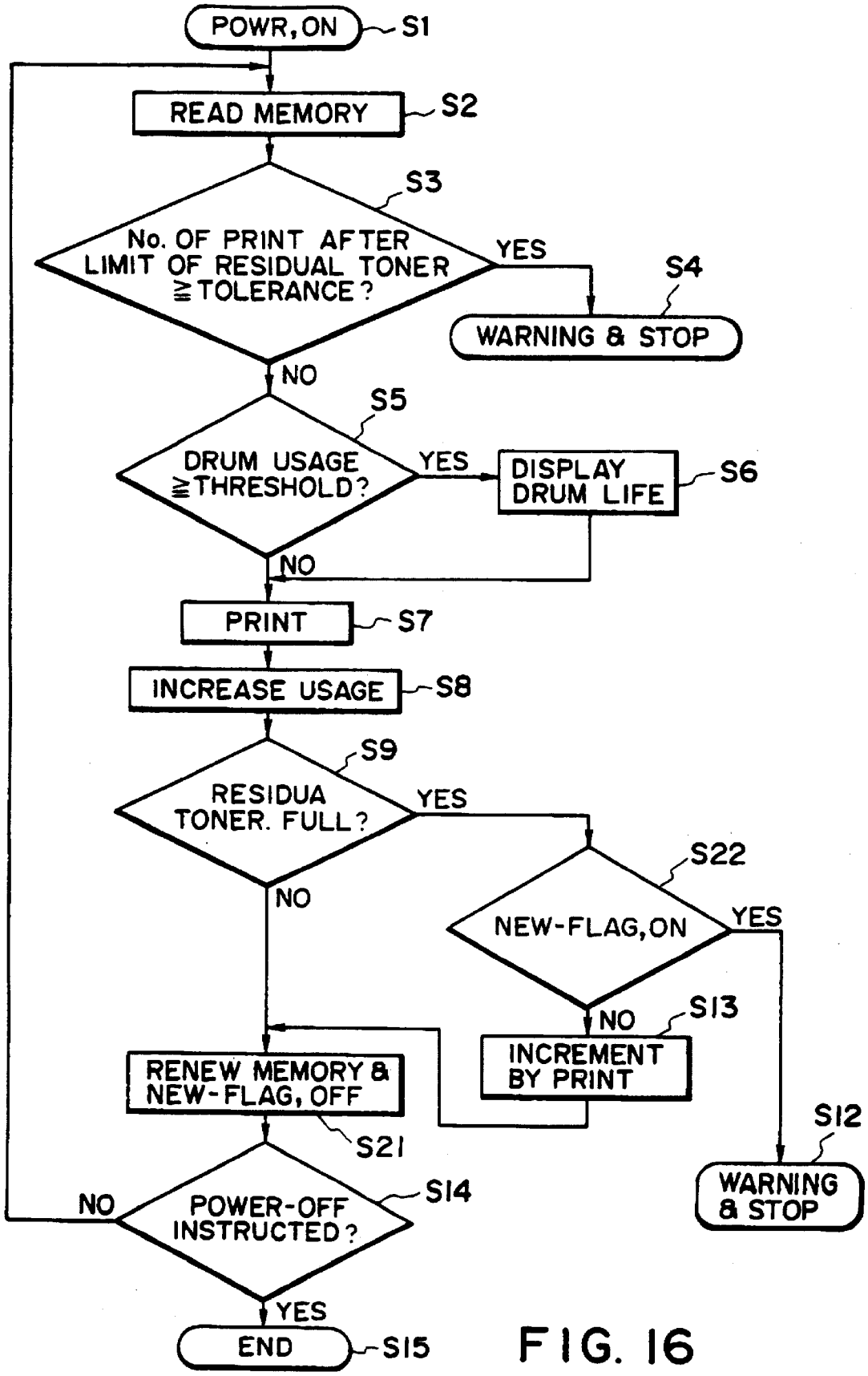
FIG. 16 is a flowchart showing an operation of the CPU in Embodiment 2.

Referring to FIG. 15 and 16, Embodiment 2 will be described. FIG. 15 shows an address map which is different from that of Embodiment 1 as to the EEPROM 207 in the photosensitive drum cartridge 90. FIG. 16 is a flowchart, relating to this embodiment, of the CPU 14 operation shown in FIG. 3. The same reference numerals are assigned to the parts having the corresponding functions as with the Embodiment 1.

As shown in FIG. 15, the address map of the EEPROM 207 in this embodiment has a read only memory area for a manufacturing number 509, a drum lifetime threshold 510 and a tolerable number of 511 after the collected toner FU11, and a random access memory for the drum use time period 513, the print number 514 after the detection of collected toner FU11 and the NEW-flag 530.

The NEW-flag 530 is "1" when it is delivered from the plant to indicate that it is new. The main assembly of the printer overwrites it to zero when even one printing operation is carried out.

The operation of the CPU 14 will be described using the flowchart in FIG. 16. Until the drum use time is incremented (S8) as a result of the printing operation (S7), operations are the same as with Embodiment 1. Subsequently, the output signal of the collected toner FULL-sensor is monitored (S9). When the full state is not detected by the sensor, the data stored temporarily in the RAM of the CPU 14 is written in the EEPROM 207, and if the cartridge is a new one, the NEW-flag is reverted (S21). If the full state is detected by the sensor, the discrimination is made as to whether the NEW-flag is "on" or not (S22).

If so, a collected toner sensor abnormality is displayed, and the printing operation is stored (S12). If not, the print number after the collected toner FU11 stored temporarily in the RAM of the CPU, is incremented (S13). The data stored temporarily in the RAM of the CPU 14 is written in EEPROM 207, and when the cartridge is a new one, the NEW-flag is reverted.

Then, the discrimination is made as to whether the deactivation of the main switch is instructed or not. If so, the main switch is deactivated (S14). If not, the above-described operations are repeated.

According to this embodiment, by the provision of the region for the NEW-flag in the address map of the EEPROM, immediate diagnosis of an abnormality of the collected toner sensor in the main assembly of the printer is possible even when the sensor involves some trouble at the beginning of the use of the printer, so that highly reliable cartridge life detection is accomplished.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an image bearing member;

a container for containing developer removed from said image bearing member;

detecting means for detecting an amount of developer removed from said image bearing member and contained in said container; and failure detecting means for detecting a failure of said developer amount detecting means on the basis of information relating to a degree of use of said image bearing member and a detection result of said developer amount detecting means.

2. An apparatus according to claim 1, wherein said failure detecting means detects a failure by determining whether an integrated use time period of said image bearing member is smaller than a predetermined time period.

3. An apparatus according to claim 1, wherein said image bearing member and said container are detachably mountable as a unit relative to said apparatus.

4. An apparatus according to claim 1, wherein said image bearing member includes an electrophotographic photosensitive member.

5. An apparatus according to claim 1, wherein said failure detecting means detects a failure of said developer amount detecting means on the basis of information relating to a degree of use of said image bearing member and a detection result of said developer amount detecting means that said container contains a predetermined amount of developer removed from said image bearing member.

6. An image forming apparatus for forming an image using a developer, said apparatus comprising:

a unit detachably mountable relative to a main assembly of said apparatus, said unit including and image bearing member and a container for accommodating a developer removed from said image bearing member;

detecting means for detecting an amount of developer removed from said image bearing member and contained in said container; and control means for controlling an operation of said apparatus on the basis of both information relating to a degree of use of said unit and an output of said detecting means;

wherein said control means stops an image forming operation of said apparatus when the information relating to the degree of use of said unit does not reach a predetermined level, which is lower than a service life of said unit, at a time when said detecting means detects a predetermined quantity.

7. An apparatus according to claim 6, further comprising charging means for charging said image bearing member, wherein the information is a charging time period of said charging means.

8. An apparatus according to claim 6, further comprising memory for storing an information of the predetermined level and an information of the predetermined quantity.

9. An apparatus according to claim 8, wherein said memory is provided in said unit.

10. An apparatus according to claim 8, wherein the information of the predetermined level is a degree of use of said image bearing member, wherein said memory further stores an information relating to a life of said image bearing member, which is higher than the predetermined level.

11. An image forming apparatus for forming an image using a developer, said apparatus comprising:

a unit detachably mountable relative to a main assembly of said apparatus, said unit including an image bearing member and a container for accommodating a developer removed from said image bearing member;

detecting means for detecting an amount of developer removed from said image bearing member and contained in said container; and a display;

wherein if an information relating to a degree of use of said unit does not reach a predetermined level which is lower than a service life of said unit, at a time when said detecting means detects a predetermined quantity of developer; said display indicates an abnormal state.

12. An apparatus according to claim 6 or 11, wherein the information is a time period of rotation of said image bearing member.

13. An apparatus according to claim 6 or 11, wherein the information is a number of rotations of said image bearing member.

14. An apparatus according to claim 6 or 11, wherein the information is a number of prints.

15. An apparatus according to claim 6 or 11, or wherein the predetermined level corresponds to information that said unit has been put to use.

16. An apparatus according to claim 11, further comprising memory for storing information of the predetermined level and information of the predetermined quantity.

17. An apparatus according to claim 16, wherein said memory is provided in said unit.

18. An apparatus according to claim 16, wherein the information of the predetermined level is a degree of use of said image bearing member, wherein said memory further stores an information relating to a life of said image bearing member which is higher than the predetermined level.

* * * * *

UNITED STATES PATENT AND TRADEMARK OFFICE

CERTIFICATE OF CORRECTION

PATENT NO. : 6,253,035 B1
DATED : June 26, 2001
INVENTOR(S) : Takashi Kawana et al.

It is certified that error appears in the above-identified patent and that said Letters Patent is hereby corrected as shown below:

Column 2,
Line 36, "In" should read -- in --.

Column 4,
Line 32, "embodiment" should read -- embodiment. --;
Line 53, "to" should be deleted;
Line 59, "density" should read -- density. --; and
Line 65, "the" (second occurrence) should read -- a --.

Column 5,
Line 27, "emitting" should read -- transmitting --.

Column 7,
Line 65, "above described" should read -- above-described --.

Column 10,
Line 10, "and" should read -- an --; and
Line 60, "developer;" should read -- developer, --.

Column 11,
Line 3, "or" (second occurrence) should be deleted.

Signed and Sealed this

Twenty-eighth Day of May, 2002

*Attest:*

*Attesting Officer*

JAMES E. ROGAN
*Director of the United States Patent and Trademark Office*